US005913093A

United States Patent [19]

Yamanaka et al.

[11] Patent Number: 5,913,093

[45] Date of Patent: Jun. 15, 1999

[54] SHEET OUTPUTTING APPARATUS OF IMAGE FORMING APPARATUS

[75] Inventors: Takashi Yamanaka, Yamatokoriyama; Toyoaki Nanba, Higashiosaka; Tomomi Tanaka; Masao Matsui, both of Yamatokoriyama, all of Japan

[73] Assignee: Sharp Kabushiki Kaisha, Osaka, Japan

[21] Appl. No.: 08/975,321

[22] Filed: Nov. 21, 1997

[30] Foreign Application Priority Data

Dec. 16, 1996 [JP] Japan ..... 8-335936

[51] Int. Cl.[6] ..... G03G 15/0065

[52] U.S. Cl. ..... 399/82; 399/397; 399/403

[58] Field of Search ..... 399/381, 383, 399/388, 393, 397, 405, 403, 407, 82; 270/52.01; 271/287

[56] References Cited

FOREIGN PATENT DOCUMENTS 5-306064 11/1993 Japan .

*Primary Examiner*—Arthur T. Grimley

*Assistant Examiner*—George E. Wendal, Jr.

[57] ABSTRACT

Structure is provided to efficiently discharge sheets outputted from an image forming apparatus to a plurality of bins. In a copier, for an original supplied from a document feeder, an image forming apparatus forms an image on a sheet supplied from a sheet feeder, and the sheet is discharged through a sheet discharging port. A sheet outputting apparatus receives discharged sheets through a sheet receiving port. In accordance with information of a job relating to the sheets copied supplied through an operation panel, a control unit causes the sheets to be distributed to be discharged to a plurality of bins. The number of acceptable sheets to each bin is detected by a detecting device. A control unit controls discharge of sheets to that the number of bins is a minimum, so that discharge to bins is easily conducted in a subsequent copying job.

6 Claims, 10 Drawing Sheets

SHEET OUTPUTTING APPARATUS OF IMAGE FORMING APPARATUS

BACKGROUND OF THE INVENTION

1. Field of the Invention

The present invention relates to a sheet outputting apparatus of an image forming apparatus that performs a post process of a sheet on which an image is formed by a copier or the like.

2. Description of the Related Art

Conventionally, a sheet on which an image is formed and outputted from an image forming apparatus such as a copier having a post-process apparatus that is called a sorter is accepted by a bin which is selected from a plurality of bins. Recently, a copier, particularly, a digital copier is commercially available as a composite apparatus which is provided with additional functions such as a printer mode and a facsimile mode, in addition to a copy mode that is originally provided to a copier. To comply with this, as a post-process apparatus which is to be disposed in a digital image forming apparatus, an apparatus having functions such as a mail box in addition to a function as a sorter is commercially produced.

A prior art technique of a post-process function is disclosed in, for example, Japanese Unexamined Patent Publication JP-A 5-306064(1993). In a copier of the prior art technique, information of the number of copy sheets allowed to be accepted by each bin of a sorter is previously stored. If it is judged that, on the basis of the stored information of the allowable sheet number, and information of the number of originals which is designated in a copy job, the allowable sheet number is smaller than the number of original sheets, copy sheets are distributed to be accepted by two or more bins through an arbitrary number of steps, and an excess number of copy sheets exceeding the allowable sheet number is distributed to a bin adjacent to a bin which has no space anymore to accept a copy sheet.

Recently various digital composite copiers having functions of a facsimile, a network printer and the like are produced. Furthermore, also many kinds of post-process apparatuses such as a mail box which automatically distributes record sheets on which an image is formed are produced. In a function such as a sorter or a mail box, however, bins to which sheets are to be discharged must be previously designated. When various functions are used during a process of discharging sheets, therefore, there arises a problem in that, unless a bin to which sheets are to be discharged is efficiently selected, discharging of sheets for a subsequent job is not conveniently carried out. In the prior art disclosed in Japanese Unexamined Patent Publication JP-A 5-306064 (1993), when the number of sheets to be discharged exceeds the allowable sheet number of a bin, sheets are discharged also to other bins. In the prior art technique, however, considerations to an efficient use of bins for discharge disposed in a sheet outputting apparatus, and to easy discharge of sheets in a subsequent job are not taken.

SUMMARY OF THE INVENTION

It is an object of the invention to provide a sheet outputting apparatus for an image forming apparatus in which bins for discharge are selected so that sheets discharged from the image forming apparatus to a plurality of bins are easily collected. It is another object of the invention to provide a sheet outputting apparatus for an image forming apparatus in which sheets are discharged while selecting a plurality of bins so that sheets are easily discharged in a subsequent job.

The invention provides a sheet outputting apparatus for an image forming apparatus comprising:

a plurality of bins for accepting sheets;

detecting means for detecting a number of acceptable sheets to each of the plurality of bins;

discharging means capable of discharging sheets into the plurality of bins;

image forming means for producing image data to form an image on a sheet on the basis of the image data; and controlling means for determining a minimum number of bins into which image formed sheets can be discharged, in correspondence to a job, to control the discharging means so that the sheets are discharged to the minimum number of bins selected from the plurality of bins.

According to the invention, the sheet outputting apparatus for an image forming apparatus comprises a plurality of bins for accepting sheets, detecting means for detecting a number of acceptable sheets to each of the plurality of bins, and discharging means for discharging sheets into the plurality of bins. The image forming means forms an image in correspondence to jobs of designating numbers of sheets and sheet sets, and the controlling means determines, from the plurality of bins, a minimum number of bins into which sheets can be discharged and controls the discharging means so that the sheets are discharged to the selected minimum number of bins. Since the number of bins which are used for one job is a minimum, cumbersome of an operation of collecting image formed sheets from the sheet outputting apparatus can be reduced, with the result that the operation of collecting sheets can be efficiently conducted.

The invention provides a sheet outputting apparatus for an image forming apparatus comprising:

a plurality of bins for accepting sheets;

detecting means for detecting a number of acceptable sheets to each of the plurality of bins;

discharging means capable of discharging sheets into the plurality of bins;

image forming means for producing image data to form an image on a sheet; and controlling means for controlling the discharging means so that a bin into which image formed sheets are to be discharged in correspondence to a job is selected from the plurality of bins in accordance with a predetermined standard and sheets corresponding to a subsequent job are easily discharged.

According to the invention, sheets on which an image is formed by the image forming means are accepted by the plurality of bins. The detecting means detects the number of acceptable sheets to each of the plurality of bins. The controlling means controls the discharging means so that sheets corresponding to a subsequent job are easily discharged, in accordance with the predetermined standard, thereby discharging the sheets to a bin selected from the plurality of bins. When a plurality of jobs are successively conducted, a bin is selected in a preceding job in consideration of easiness of an operation of discharging sheets in a subsequent job, and sheets are then discharged. Therefore, the plurality of jobs can be efficiently executed as a whole. Furthermore, sheets on which an image is formed and which are discharged to the plurality of bins are collected to a certain extent, and hence the labor of collecting the sheets can be reduced, with the result that the bins can be efficiently used.

In the invention, the controlling means determines bins to which the sheets are to be discharged so that a total of numbers of acceptable sheets of bins into which the sheets are to be discharged is a minimum.

According to the invention, the controlling means determines bins to which the sheets are to be discharged so that the total of the numbers of acceptable sheets of bins to which sheets are to be discharged is a minimum. Therefore, an operation of discharging sheets is conducted in the current job with efficiently using the selected bins, and a bin of a large number of acceptable sheets is left for a subsequent job, thereby enabling bins to be efficiently used also in the subsequent job.

In the invention, the controlling means determines bins to which sheets are to be discharged so that, after the sheets are discharged, the number of acceptable sheets of one bin is a maximum.

According to the invention, the controlling means determines bins to which the sheets are to be discharged so that the number of acceptable sheets of one bin is a maximum. Therefore, a large number of sheets can be discharged into one bin in a subsequent job, thereby allowing the operation of collecting sheets to be efficiently conducted.

In the invention, the controlling means determines bins to which sheets are to be discharged so that, after the sheets are discharged, the number of empty bins which are successive is a maximum.

According to the invention, the controlling means controls discharge of sheets with determining bins to which the sheets are to be discharged so that the number of empty bins which are successive is a maximum. Therefore, sheets can be discharged in a subsequent job to successive bins. Consequently, the labor of collecting the sheets can be reduced, with the result that the bins can be efficiently used.

In the invention, the controlling means determines bins to which sheets are to be discharged so that, after the sheets are discharged, a total of numbers of acceptable sheets of empty bins which are successive is a maximum.

According to the invention, the controlling means controls discharge of sheets with determining bins to which the sheets are to be discharged so that a total of numbers of acceptable sheets to empty bins which are successive is a maximum. For a larger number of sheets, therefore, sheets can be discharged in a subsequent job while selecting empty bins which are successive. Consequently, the bins can be efficiently used.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
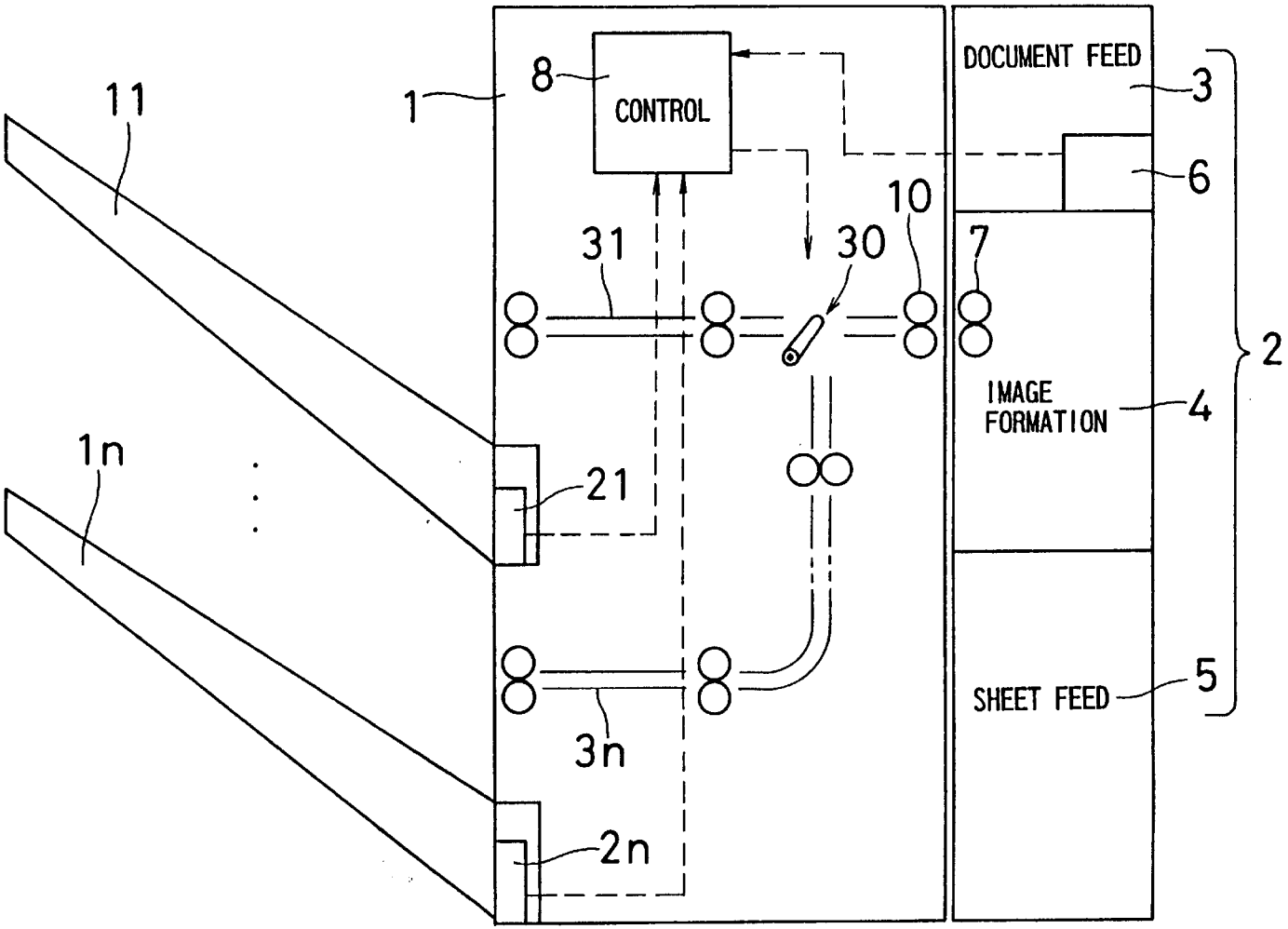
FIG. 1 is a block diagram diagrammatically showing the configuration of an embodiment of the invention.

Now referring to the drawings, preferred embodiments of the invention are described below.

FIG. 1 diagrammatically shows the configuration of an embodiment of the invention. A sheet outputting apparatus 1 is disposed on the sheet discharging side of a copier 2. The copier 2 comprises a document feeder 3, an image forming apparatus 4, and a sheet feeder 5. An instruction for operations of the copier 2 is input as a job through an operation panel 6 of the image forming apparatus 4. In the copier 2, in accordance with an input job, the image forming apparatus 4 forms an image on a sheet which is supplied from the sheet feeder 5, and the sheet discharged through a sheet discharging port 7 is supplied to the sheet outputting apparatus 1.

In the sheet outputting apparatus 1, information of the job input through the operation panel 6 is given to an internal control unit 8, so that the sheet is received through a sheet receiving port 10. The control unit 8 of the sheet outputting apparatus 1 can control sheets discharged in accordance with a job so as to be selectively discharged to a plurality of bins 11 to 1n. Detecting means 21 to 2n for detecting a number of acceptable sheets are disposed in the bins 11 to 1n, respectively. The detecting means 21 to 2n send detection results of the number of acceptable sheets to the control unit 8. In accordance with the numbers of acceptable sheets supplied from the bins 11 to 1n, the control unit 8 controls transportation direction switching means 30 and sheet guide transport paths 31 to 3n which serve as the discharging means, and selects one of the bins 11 to 1n to which a sheet is to be discharged. The transportation direction switching means 30 switches over the sheet guide transport paths 31 to 3n respectively disposed for the bins 11 to 1n, by means of a switching pawl or the like.

Figure 2:
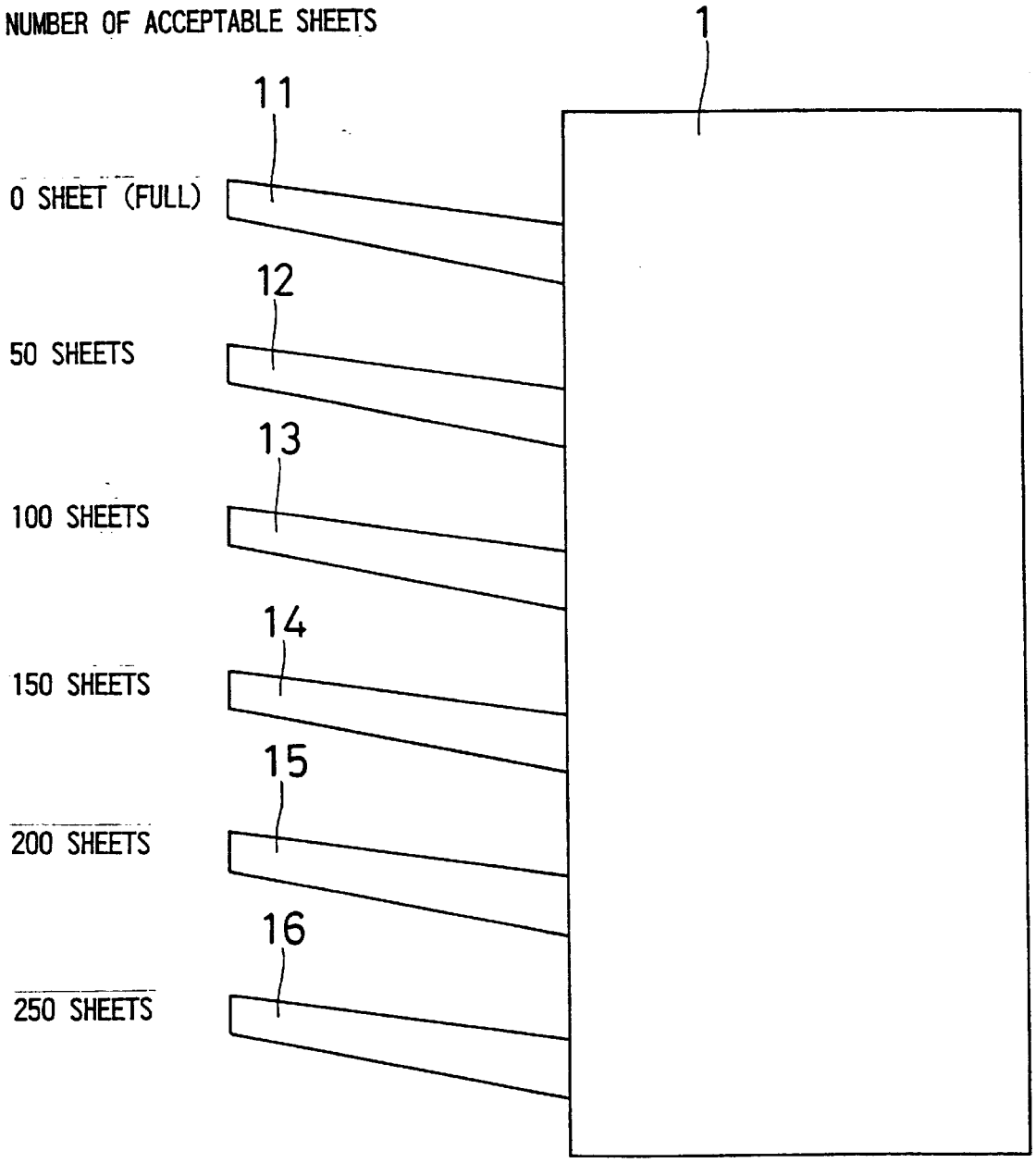
FIG. 2 is a diagram showing preconditions of illustration of an operation of the embodiment of FIG. 1.

FIG. 2 shows a state in which the sheet outputting apparatus 1 comprises six stages of bins, or a first bin 11, a second bin 12, a third bin 13, a fourth bin 14, a fifth bin 15, and a sixth bin 16 and the bins currently have the numbers of acceptable sheets of 0, 50, 100, 150, 200, and 250, respectively. The first bin 11 in which the number of acceptable sheets is 0 is already full. It is assumed that 350 sheets are to be discharged. As shown in Table 1 below, bins to which the sheets are to be discharged can be selected in either of five manners, or A, B, C, D, and E.

TABLE 1

| | number of acceptable sheets | A | B | C | D | E |
|---|---|---|---|---|---|---|
| first bin | 0 | | | | | |
| second bin | 50 | | | | | ○ |
| third bin | 100 | ○ | | | | ○ |
| fourth bin | 150 | | ○ | | ○ | |
| fifth bin | 200 | | | ○ | ○ | ○ |
| sixth bin | 250 | ○ | ○ | ○ | | |
| number of selected bins | | 2 | 2 | 2 | 2 | 3 |
| total of numbers of acceptable sheets | | 350 | 400 | 450 | 350 | 350 |
| maximum number of acceptable sheets after discharge (one bin) | | 200 | 200 | 150 | 250 | 250 |

First, comparison will be conducted on numbers of bins to which the sheets are to be discharged. In E, three bins are used. When A, B, C, or D is selected, two bins are used. Namely, the minimum number of bins is two. Therefore, cumbersome of an operation of collecting sheets after discharge can be reduced in degree, with the result that sheets can be easily collected. Next, comparison will be conducted on the numbers of acceptable sheets of selected bins. In B and C, the numbers of acceptable sheets are 400 and 450, respectively. By contrast, when A or D is selected, the number of acceptable sheets is 350 or a minimum. When A or D is selected, it is possible to leave a bin of which number of acceptable sheets is large, and hence the bins can be efficiently used in a subsequent job.

Next, A and D are compared with each other. In A, the third and sixth bins are selected and the sixth bin has the maximum number of acceptable sheets of 250. In D, the fourth and fifth bins are selected and the fifth bin has the maximum number of acceptable sheets of 200. When the numbers of acceptable sheets to the bins which attain the maximum number of acceptable sheets are compared with each other and the combination of which maximum number of acceptable sheets is 200 or a minimum, i.e., D is selected, it is possible to maximize the number of acceptable sheets to one bin after discharge of sheets, with the result that, even when the number of sheets to be discharged in a subsequent job is increased, the sheets can be discharged to one bin.

In FIG. 2, the bins 11 to 16 have different sheet acceptance capacities. It is possible to handle in the same manner two cases, i.e., a case where the bins, which originally have the same sheet acceptance capacity, are already occupied by discharged sheets, and another case where the bins, which originally have different sheet acceptance capacities, are empty.

Figure 3:
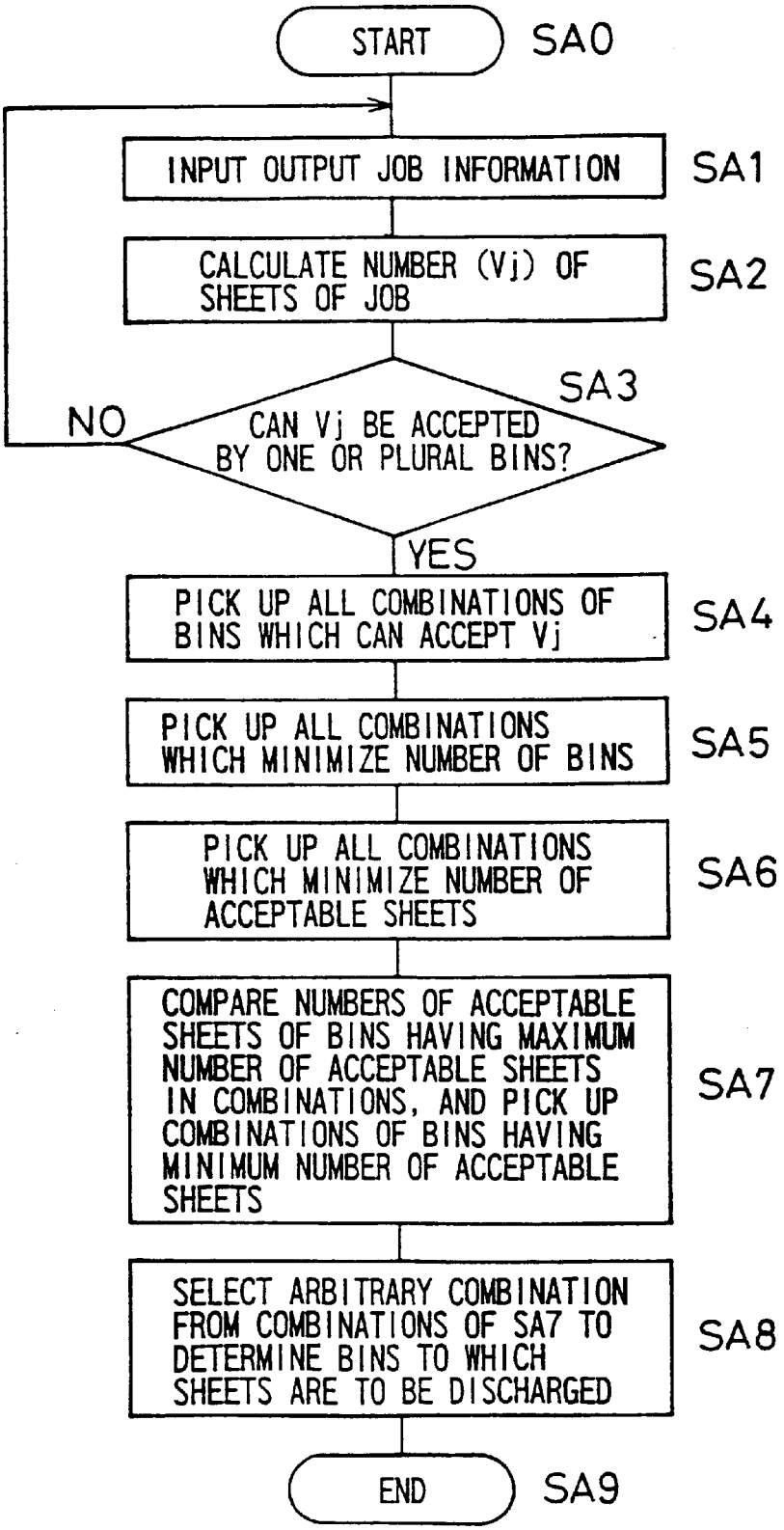
FIG. 3 is a flowchart showing a process of the embodiment of FIG. 1.

FIG. 3 shows a process of the control unit 8 shown in FIG. 1. The operation starts at step SA0, and the user inputs at step SA1 the number of sheets and that of sheet sets, as information of an output job. At step SA2, the total number Vj of sheets of the output job is calculated on the basis of the input information of the output job. In the example of FIG. 2, Vj=350. It is judged at step SA3 whether Vj can be accepted by one or more bins or not. If Vj cannot be accepted, the control returns to step SA1. In this case, information indicating that the job cannot be executed is displayed. If it is judged at step SA3 that Vj can be accepted, all bins which can house sheets are picked up at step SA4. In the example of FIG. 2, A, B, C, D, and E of Table 1 are picked up. At step SA5, all combinations in which the number of bins is a minimum are picked up. In the example of FIG. 2, A, B, C, and D of Table 1 are picked up. At step SA6, from the picked up combinations, all combinations in which the number of acceptable sheets is a minimum are picked up. In the example of FIG. 2, A and D are picked up from Table 1. At step SA7, the numbers of acceptable sheets to bins having the maximum number of acceptable sheets in respective picked up combinations are compared with each other, and all combinations containing a bin of the minimum number of acceptable sheets are picked up. In the example of FIG. 2, D is picked up from Table 1.

Finally, at step SA8, an arbitrary combination is selected from the combinations picked up at step SA7, and bins to which the sheets are to be discharged are determined. The process is ended at step SA9. In the example of FIG. 2, only D in Table 1 is selected, and hence the 350 sheets are discharged to the fourth and fifth bins 14 and 15.

Figure 4:
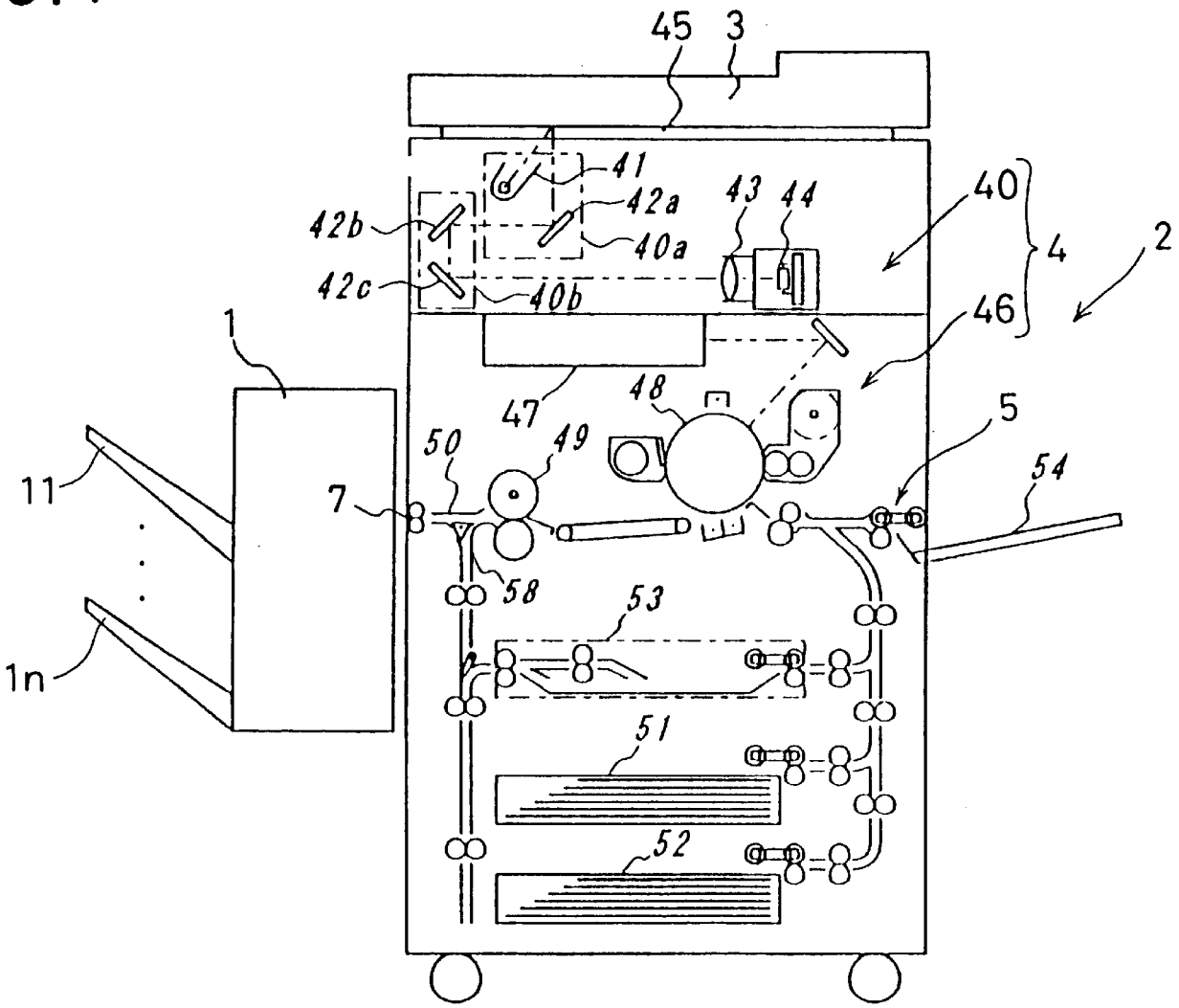
FIG. 4 is a simplified section view showing the whole configuration of a copier 2 of the embodiment of FIG. 1.

FIG. 4 shows the whole configuration of the copier 2 having the sheet outputting apparatus 1 of the embodiment. The surface of an original supplied from the document feeder 3 is irradiated with light of a lamp and reflector assembly 41. Scan units 40*a* and 40*b* have reflecting mirrors 42*a*, 42*b*, and 42*c* which guide reflected light from the surface of the original. The reflected light enters a CCD 44 which is a photoelectric converting element, via an optical lens system 43. The original is exposed under a state it is placed on an original table 45 made of a transparent glass.

A scanner unit 40 converts the reflected light image from the original into an electric image signal, and a laser printer unit 46 then forms an image on a sheet. The electric image signal is supplied to a laser writing unit 47 of the laser printer unit 46. The laser writing unit 46 comprises: a semiconductor laser device which emits a laser beam in accordance with an image data; a polygon mirror which deflects the laser beam at a constant angular velocity; and an f-θ lens which corrects the laser beam deflected at a constant angular velocity so as to be deflected at a constant velocity on a photoreceptor drum 48 on which an electrophotographic process is to be conducted by the laser printer unit 46. In order to perform an electrophotographic process, a charger, a developer, a transfer device, a separator, a cleaner, a discharger, and a fixing device 49 are arranged around the photoreceptor drum 48 in accordance with a well-known manner. An electrostatic latent image is formed on the photoreceptor drum 48 by the laser beam. The image is developed by toner supplied from the developer. A toner image on a sheet is fixed by the fixing device 49, thereby completing an image formation.

A sheet discharge transport path 50 is disposed on the downstream side of the fixing device 49 in the sheet transport direction. Sheets for an image formation are supplied from first and second cassettes 51 and 52 disposed under the sheet feeder 5. The first and second cassettes 51 and 52 house sheets of different sizes, and selectively supply a new sheet in accordance with an instruction of the job. When the job instructs the double-face copy, sheets in which the copy operation has been conducted on one face are temporarily stored in a double-face copy unit 53. A manual feed tray 54 is disposed outside the sheet feeder 5 so that the user can directly supply sheets from the outside. The sheet discharge transport path 50 branches into the sheet discharging port 7 through which sheets are discharged to the sheet outputting apparatus 1 serving as a post-process apparatus, and a double-face copy transport path 58 leading to the double-face copy unit 53.

Figure 5:
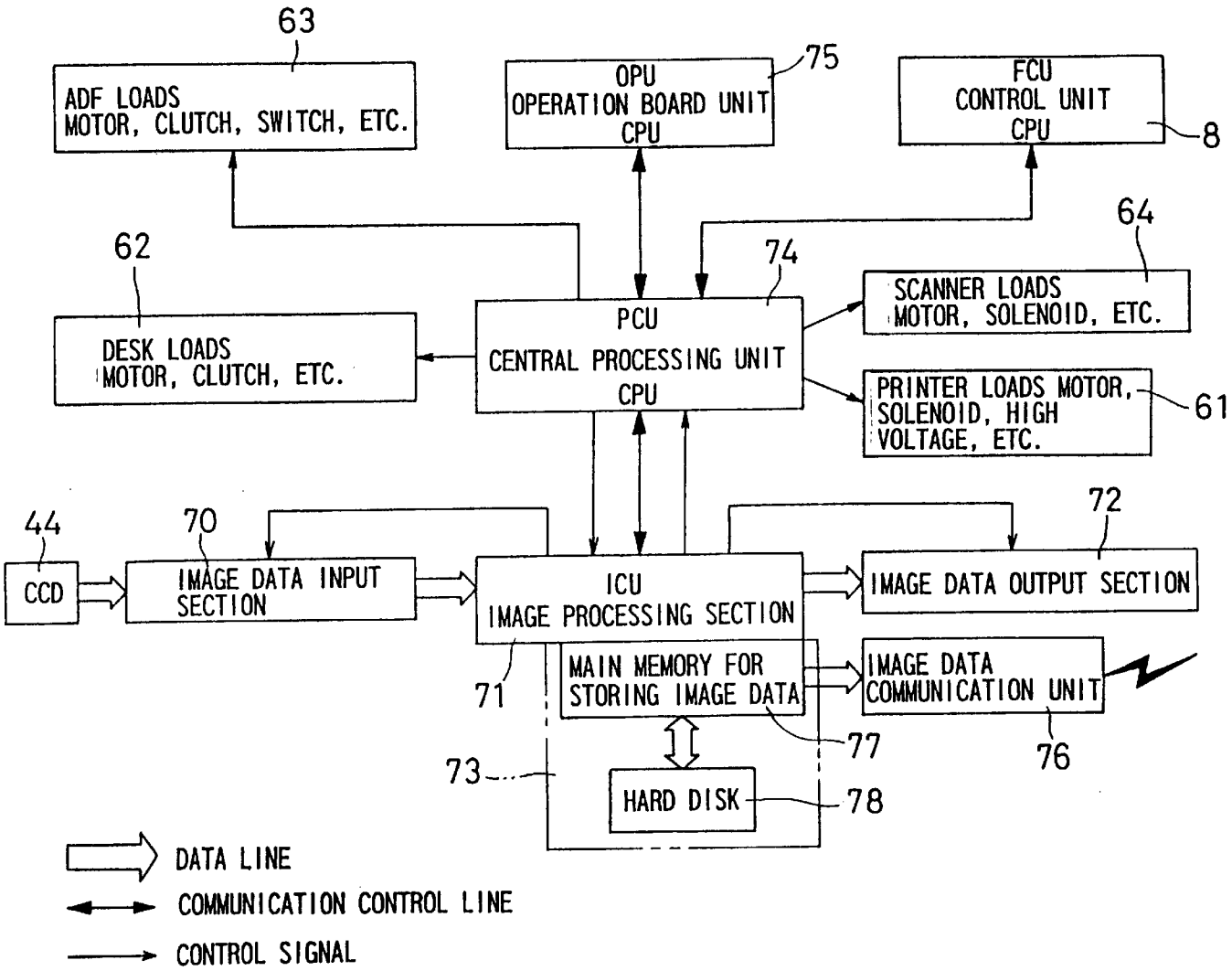
FIG. 5 is a block diagram showing the electric configuration for controlling the whole of the copier 2 of FIG. 4.

FIG. 5 shows the configuration for controlling the whole of the copier 2 shown in FIG. 4. Loads which are to be controlled include: printer loads 61 including a motor, a solenoid, and a high voltage device of the laser printer unit 46; desk load 62 including a motor and a clutch of the sheet feeder 5; loads 63 relating to automatic document feeding (abbreviated as "ADF") such as a motor, a clutch, and a switch of the document feeder 3, and scanner loads 64 such as a motor and a solenoid of the scanner unit 40. The image signal from the CCD 44 of the scanner unit 40 is supplied to the image data input section 70, subjected to an image process according to the job in an image processing section 71, and then supplied from an image data output section 72 to the laser writing unit 47 of FIG. 4. In the image processing section 71, the image process is conducted by using a memory device 73. The whole operation of the copier 2 is controlled by a central processing unit 74. A job for the copier 2 is given to the central processing unit 74 via an operation board unit 75, and information of a job for the sheet outputting apparatus 1 is given from the central processing unit 74 to the control unit 8. The copier 2 has also a facsimile function so that an image data is communicated via an image data communication unit 76. The memory device 73 includes a main memory 77 for storing image data, and a hard disk drive 78 of a large capacity.

Figure 6:
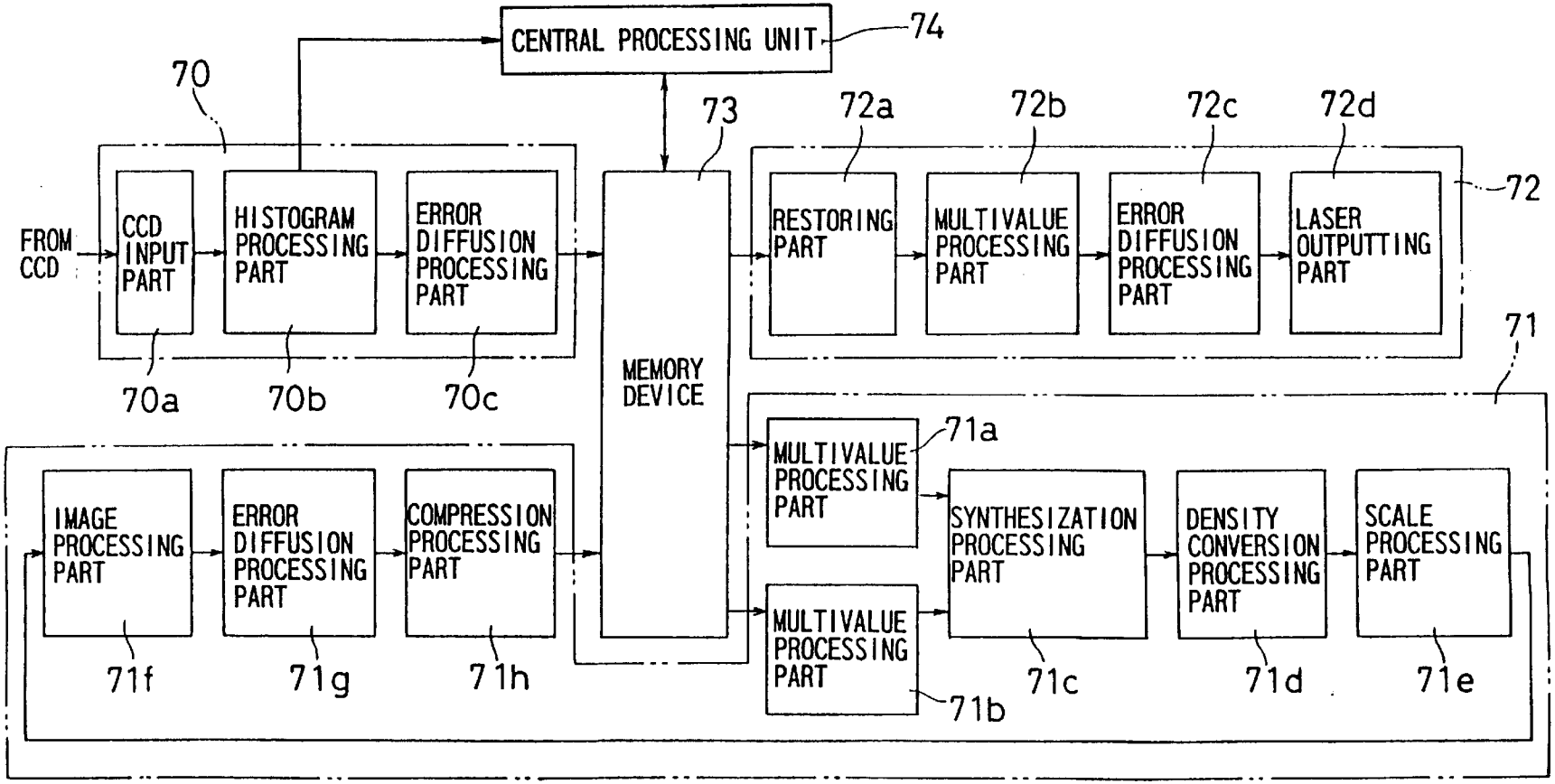
FIG. 6 is a block diagram showing the electric configuration for an image process of the copier 2 of FIG. 4.

FIG. 6 shows the configuration for conducting a digital image process in the copier 2. The image data input section 70 comprises a CCD input part 70*a,* a histogram processing part 70*b,* and an error diffusion processing part 70*c*. In the CCD input part 70*a,* the image data of the original read from the CCD 44 in the form of analog signals respectively corresponding to pixel densities of the image data is analog/digital (abbreviated as "A/D") converted, and then subjected to the MTF correction, the white and black correction, or the γ correction. The resulting signals are supplied as digital signals of 8 bits or 256 levels to the histogram processing part 70*b*. In the histogram processing part 70*b,* the digital signals are accumulated for each of pixel densities of 256 levels, so as to obtain histogram data serving as density information. As required, the histogram data are supplied to the central processing unit 74, and as image data to the error diffusion processing part 70*c*. In the error diffusion processing part 70*c,* each digital signal of 8 bits/pixel supplied from the CCD input part 70*a* is converted into a 1-bit signal by the error diffusion method which is a kind of pseudo intermediate process, i.e., a method in which an error of a binarizing process is reflected to judgement on binarization of adjacent pixels. A redistribution calculation is conducted in order to faithfully reproduce the density of each local area of the original.

The image processing section 71 comprises multivalue processing parts 71*a* and 71*b,* a synthesization processing part 71*c,* a density conversion processing part 71*d,* a scale processing part 71*e,* an image processing part 71*f,* an error diffusion processing part 71*g,* and a compression processing part 71*h*. In the multivalue processing parts 71*a* and 71*b,* the data which has been binarized in the error diffusion processing part 70*c* is converted so as to be returned to a data of 256 levels. The synthesization processing part 71*c* selectively conducts logical calculation processes for each pixel, i.e., calculation processes of disjunction, conjunction, or exclusive disjunction. The data which is to be subjected to the calculation is the pixel data stored in the memory device 73 and a bit data supplied from a pattern generator (abbreviated as "PG") which is not shown. In the density conversion processing part 71*d,* relationships between the input density and the output density are set on the 256-level data signal on the basis of a predetermined gray scale conversion table. In accordance with a scaling factor designated in the job, the scale processing part 71*e* performs an interpolation process based on an input known data, thereby obtaining a pixel data as a density value for the image to be processed which has undergone the scaling process. After the scale in the sub scanning direction is modified, the scaling process is performed on the scale in the main scanning direction. The image processing part 71*f* performs various image processes on the input pixel data and also information collection such as feature extraction on a data string. The error diffusion processing part 71*g* performs processes which are similar to those of the error diffusion processing part 70*c* of the image data input section 70. In the compression processing part 71*h,* the binary data is compressed by a coding process such as a process which is called run-length. With respect to the compression of the image data, the compression process operates in the loop of the final process at the timing when a final output image is completed.

The image data output section 72 comprises a restoring part 72*a,* a multivalue processing part 72*b,* an error diffusion processing part 72*c,* and a laser outputting part 72*d*. The restoring part 72*a* restores the image data which has been compressed by the compression processing part 71*h*. The multivalue processing part 72*b* performs processes which are similar to those of the multivalue processing parts 71*a* and 71*b* of the image data input section 70. The error diffusion processing part 72*c* performs processes which are similar to those of the error diffusion processing part 70*c* of the image data input section 70. In the laser outputting part 72*d,* the digital pixel data is converted into on/off signals for the laser writing unit 47 on the basis of a control signal supplied from a sequence controller which is not shown, so as to turn on/off the semiconductor laser device, whereby an electrostatic latent image is written on the photoreceptor drum 48.

Basically, the data which is to be handled in the image data input section 70 and the image data output section 72 is stored in the memory device 73 in the form of a binary data, in order to reduce the capacity of the main memory 78. Alternatively, the image data may be processed in the form of a four-level data in consideration of degradation of the image data.

Figure 7:
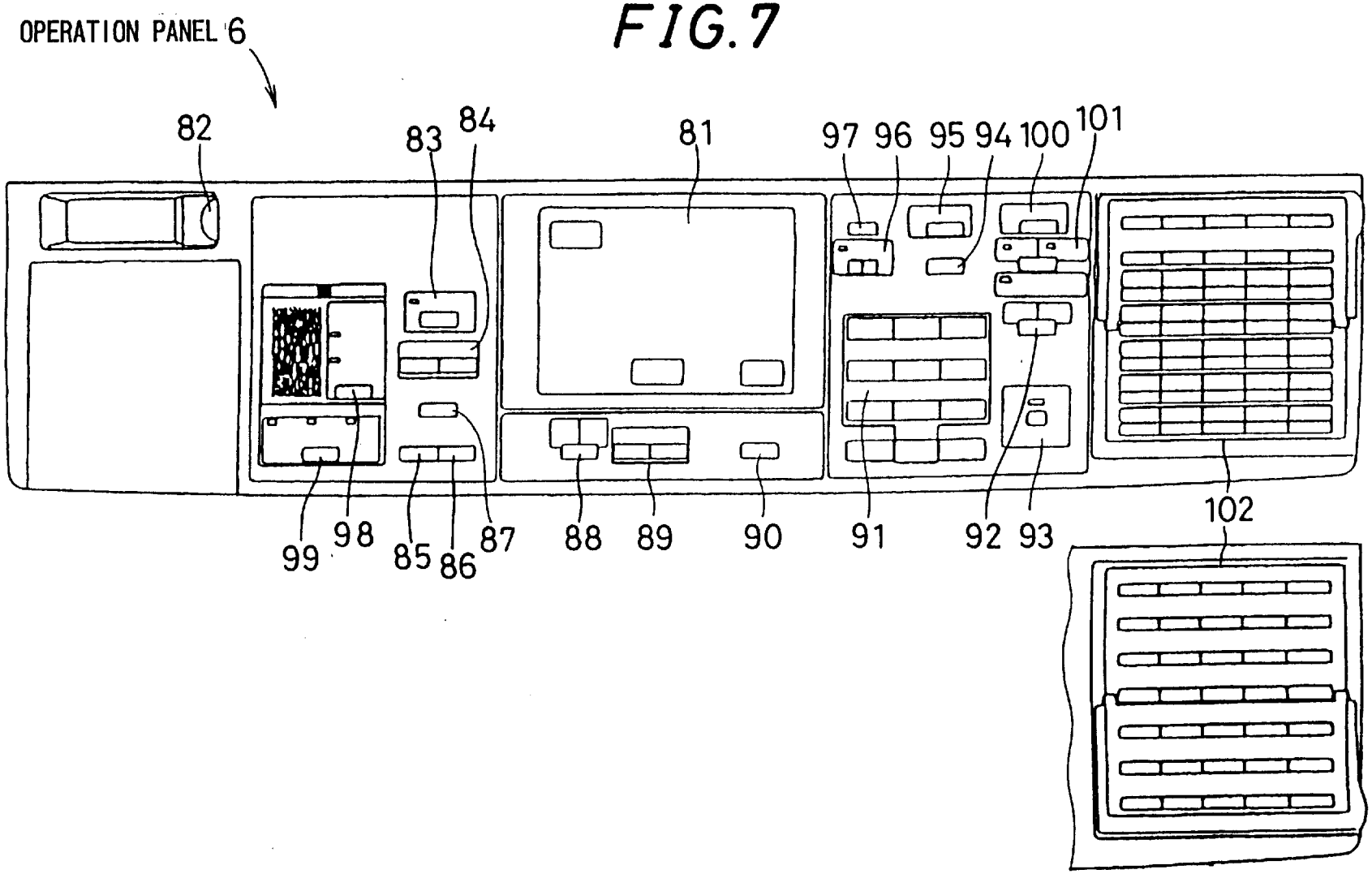
FIG. 7 is a view showing an operation panel 6 shown in FIG. 1.

FIG. 7 shows the operation panel 6 of the copier 2. A touch panel type liquid crystal display device 81 is disposed in a center area of the operation panel 6. A group of setting keys for the facsimile mode is arranged around the display device. A screen switch Instruction area for switching to a screen of selecting an image editing function is always displayed on the display screen of the touch panel type liquid crystal display device 81. When the area is directly pressed by a finger, various editing functions are listed on the liquid crystal screen so that various image editing functions are selected. When the operator touches with a finger an area corresponding to a desired one of the displayed editing functions, the selected editing function is set.

The group of various setting keys which are arranged on the operation panel 6 will be briefly described. In order to control the screen of the liquid crystal display device 81, a brightness adjust dial 82 is disposed. Furthermore, the setting keys include: an automatic magnification setting key 83 for setting a mode of automatically setting the magnification factor; a zoom key 84 for setting the copy magnification factor in increments of 1%; fixed magnification factor keys 85 and 86 for reading out and selecting a fixed magnification factor; and a nonmagnification key 87 for returning the copy magnification factor to nonmagnification which is the standard magnification factor. The setting keys further include: a density switch key 88 for switching the copy density adjust method from an automatic mode to a manual mode or a photograph mode; a density adjust key 89 for finely setting the density level in the manual mode or the photograph mode; a tray selection key 90 for selecting one of the cassettes 51 and 52 and the manual feed tray 54, whereby a desired sheet size is selected from the sheet sizes which are set to the sheet feeder 5 of the copier 2; a number setting key 91 for setting the number of copy sheets; a clear key 92 for clearing the preset copy sheet number or intercepting a continuous copy operation; a start key 93 for instructing the start of a copy operation; an all clear key 94 for canceling all modes which are currently set and returning the operation mode to a standard state; and an interruption key 95 for copying another original during a continuous copy operation. The setting keys further include: an operation guide key 96 which is to be operated when the operator is in trouble in operating the copier, whereby a message instructing the manner of operating the copier is displayed; a message forward key 97 for forward advancing the message which is displayed as a result of the operation of the operation guide key 96; a double-face mode set key 98 for setting a double-face copy mode, and a post-process mode set key 99 for setting the operation mode of the sheet outputting apparatus 1 for assorting copy sheets discharged from the copier.

The copier 2 of FIG. 1 can operate also in the printer mode or the facsimile mode. Therefore, the copier is further provided with: a memory transmission mode key 100 for temporarily storing an original to be transmitted in the facsimile mode in the memory and then transmitted; a copy/facsimile and printer mode switch key 101 for switching over the mode of the copier 2 so as to be either of the copy mode and the printer/facsimile and printer mode; and one-touch dial keys 102 which previously store respective telephone numbers of transmission destinations, so that a calling operation is executed by a one-touch operation.

FIG. 7 shows an example of the configuration of the operation panel 6. It is a matter of course that the arrangement and kinds of keys may be different from the above depending on the function of the copier 2.

Figure 8:
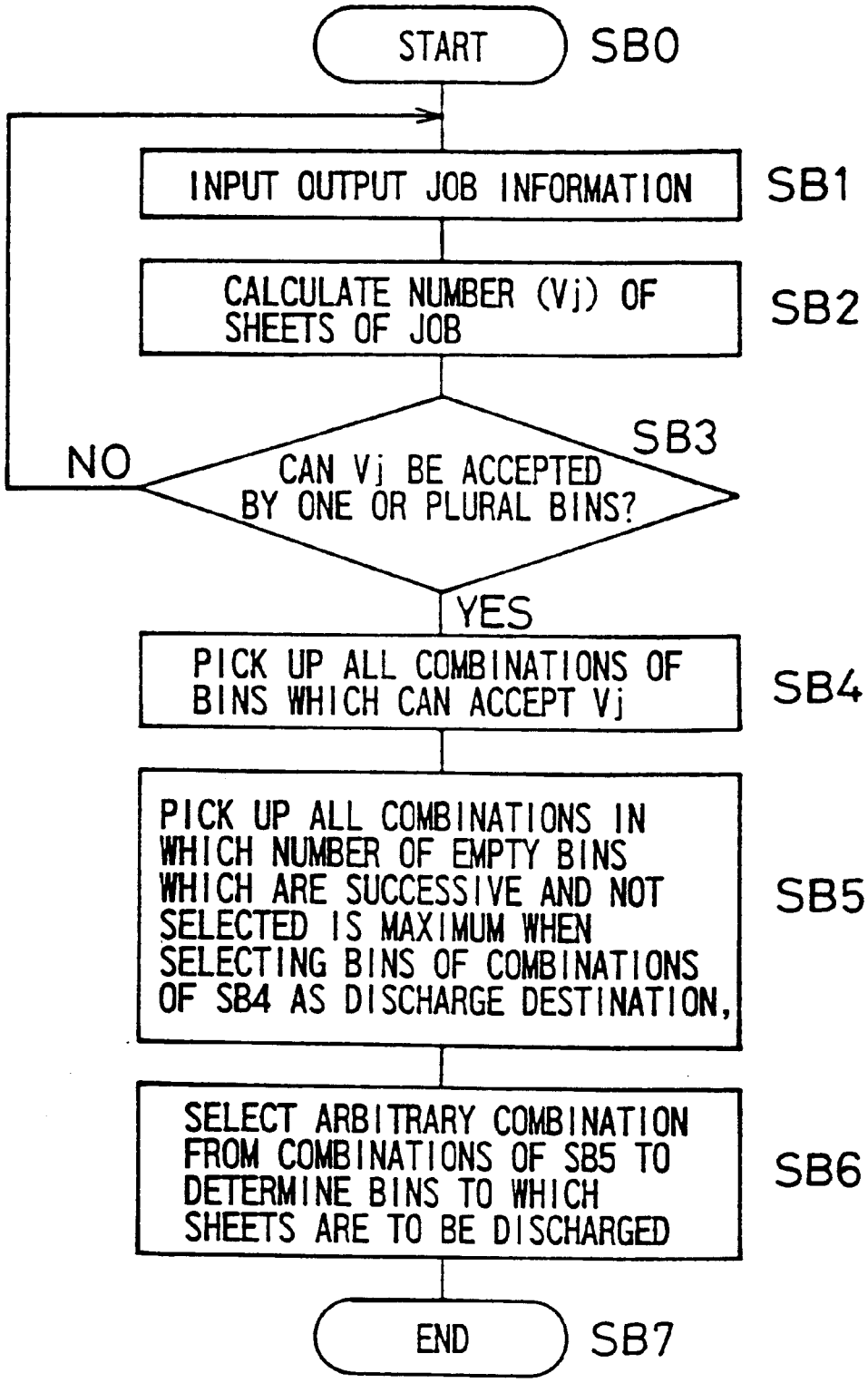
FIG. 8 is a flowchart showing a process of another embodiment of the invention.
Figure 9:
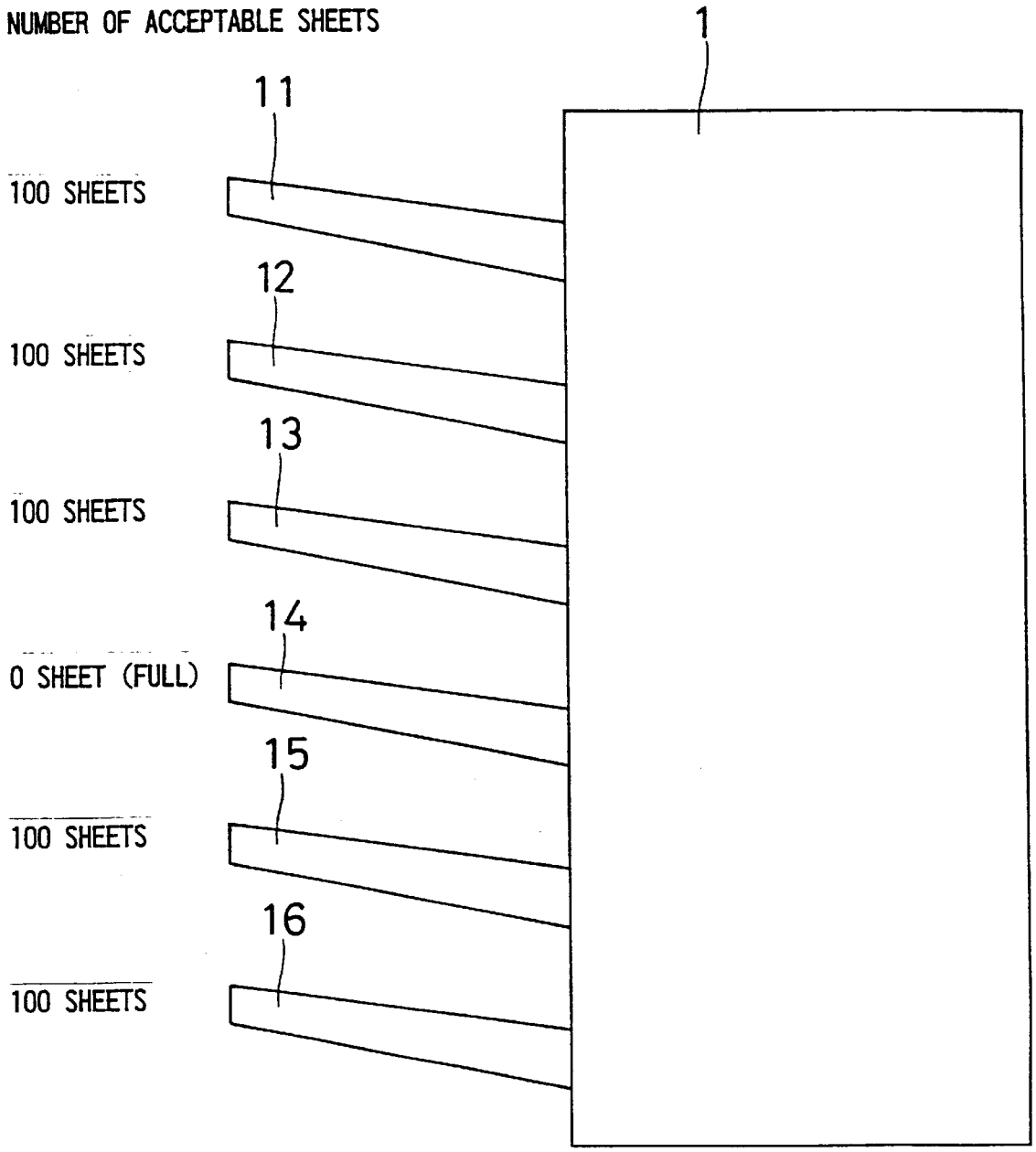
FIG. 9 is a diagram showing preconditions of illustration of a process of the other embodiment of the invention.

FIG. 8 shows a process of another embodiment of the invention, and FIG. 9 shows the numbers of acceptable sheets to the bins 11 to 16 which are preconditions of the process. FIG. 9 shows a state where all the numbers of acceptable sheets to the first to sixth bins 11 to 16 in an empty condition are 100, and only the fourth bin 14 houses sheets and is filled with the sheets. It is assumed that 200 sheets are to be discharged. In this case, the discharge is to be conducted by using two bins. When the sheets are discharged by using the fifth and sixth bins 15 and 16, three empty bins which are successive or the first, second, and third bins 11, 12, and 13 are left. In any other combination of bins to which the sheets are discharged, the number of empty bins which are successive is 2 or less. When 200 sheets are discharged to the fifth and sixth bins 15 and 16, therefore, the number of empty bins which are successive is a maximum, with the result that, even when the number of sheets to be discharged or that of sheet sets in a subsequent job is large, the sheets can be discharged to empty bins which are successive.

The process described above starts at step SB0 of FIG. 8, and the user inputs at step SB1 the number of sheets and that of sheet sets, as information of an output job. At step SB2, the total number Vj of sheets of the output job is calculated. In the embodiment, Vj=200. It is judged at step SB3 whether Vj can be accepted by one or more bins or not. If Vj>500, the sheets cannot be accepted in the state shown in FIG. 9, and hence the control returns to step SB1 and information indicating that the job cannot be executed is displayed. In the embodiment, Vj can be accepted. Therefore, all combinations of bins which can house the sheets are picked up at step SB4. Namely, combinations such as those of the first and second bins 11 and 12, and the first and third bins 11 and 13 are picked up. At step SB5, all combinations are picked up in which, when bins are selected so as to constitute a combination serving as the discharge destination, the number of empty bins which are successive and not selected is a maximum. When the combination of the fifth and sixth bins 15 and 16 is selected as the discharge destination as described above, the number of empty bins which are successive and not selected is three or a maximum, and the maximum number is attained only in the combination. Also at step SB6, therefore, only the combination of the fifth and sixth bins 15 and 16 is selected as bins to which the sheets are to be discharged. The process is ended at step SB7.

Figure 10:
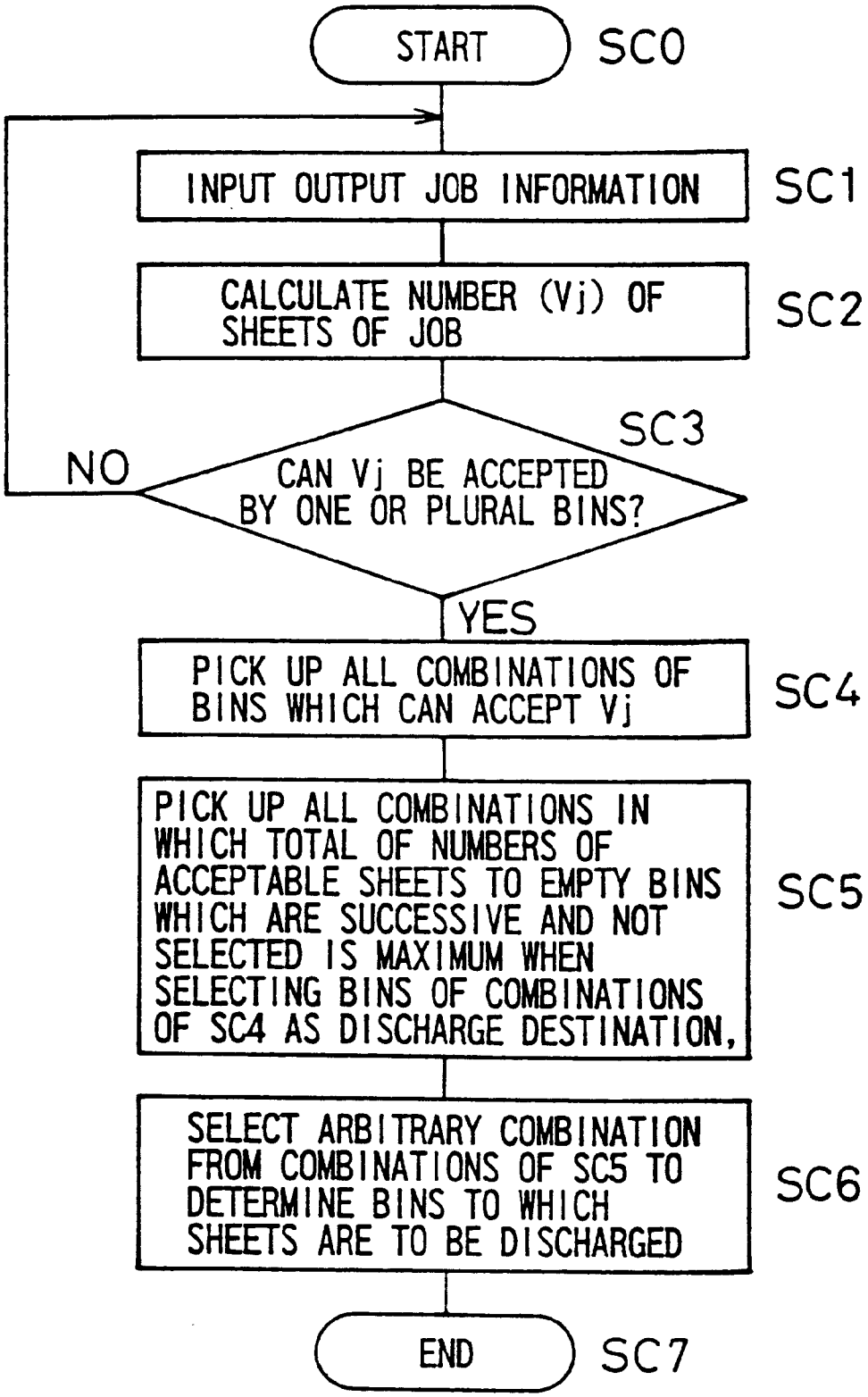
FIG. 10 is a flowchart showing a process of a further embodiment of the invention.

FIG. 10 shows a process of a further embodiment of the invention. Also the process of the embodiment will be described with using the state of FIG. 9 as preconditions. It is assumed that 100 sheets are to be discharged. In this case, the sheets can be discharged to any bin other than the fourth bin 14 in the state of FIG. 9. When the sheets are discharged to the first bin 11, the second bin 12, or the third bin 13, however, a total of the numbers of acceptable sheets to the remaining empty bins which are successive is 200. When the sheets are discharged to the fifth bin 15 or the sixth bin 16, a total of the numbers of acceptable sheets to the remaining empty bins which are successive is 300. If the sheets are discharged to the fifth bin 15 or the sixth bin 16, therefore, a total of the numbers of acceptable sheets to the remaining empty bins which are successive is a maximum, with the result that, even when the number of sheets corresponding to a subsequent job is large, the sheets can be discharged to empty bins which are successive.

The process of the embodiment starts at step SC0 of FIG. 10, and the user inputs at step SC1 the number of sheets and that of sheet sets, as information of an output job. At step SC2, the total number Vj of sheets of the output job is calculated. In the embodiment, Vj=100. It is judged at step SC3 whether Vj can be accepted by one or more bins or not. If Vj cannot be accepted, the control returns to step SC1, and information indicating that the job cannot be executed is displayed. In the embodiment, 500 sheets can be accepted at the maximum. Therefore, the control proceeds to step SC4. At step SC4, all combinations of bins which can accept Vj are picked up. In the embodiment, either of the first bin 11, the second bin 12, the third bin 13, the fifth bin 15, and the sixth bin 16 can accept Vj. At step SC5, all combinations are picked up in which, when bins are selected so as to constitute a combination serving as the discharge destination, a total of the numbers of acceptable sheets to empty bins which are successive and not selected is a maximum. In the embodiment, when the fifth bin 15 or the sixth bin 16 is selected as the discharge destination, the total number of acceptable sheets to the empty bins which are successive and selected is 300 or a maximum. Finally, at step SC6, an arbitrary combination is selected from the combinations, and bins to which the sheets are to be discharged are determined. In the embodiment, one of the fifth and sixth bins 15 and 16 is determined as the bin to which the sheets are to be discharged. The process is ended at step SC7.

In the above, the copier 2 which conducts a digital image process and has a printer function and a facsimile transmission function has been described. The invention may be similarly applied also to a copier in which an image is formed by directly guiding a reflected image from an original to a photoreceptor drum. Furthermore, the invention may be preferably executed also in, for example, a printer, and a printer server which is connected to printers or particularly to a network.

In place of the configuration in which the detecting means 21 to 2n directly detect the numbers of acceptable sheets to the bins 11 to 1n, a configuration may be employed in which an area for counting the numbers of discharged sheets is formed in the memory and the numbers of acceptable sheets are counted by a software.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet outputting apparatus for an image forming apparatus comprising:

image forming means for producing image data to form an image on a sheet on the basis of the image data;

a plurality of bins for accepting the sheets;

detecting means for detecting a number of acceptable sheets for placement in each one of the plurality of bins;

discharging means capable of discharging the sheets into the plurality of bins; and controlling means for determining automatically and selecting automatically a minimum number of bins into which the sheets can be discharged, in correspondence to the sheets processed in a copying job, and to control the discharging means so that the sheets are discharged to the minimum number of bins selected from the plurality of bins.

2. A sheet outputting apparatus for an image forming apparatus comprising:

image forming means for producing image data to form an image on a sheet on the basis of the image data, and a plurality of bins for accepting the sheets;

detecting means for detecting a number of acceptable sheets for placement in each one of the plurality of bins;

discharging means capable of discharging the sheets into the plurality of bins; and controlling means for controlling the discharging means so that a bin into which the image formed sheets are to be discharged in correspondence to the sheets processed in a copying job are automatically selected from the plurality of bins in accordance with a predetermined selection of specific ones of the plurality of bins and sheets corresponding to a subsequent job can be easily discharged.

3. The sheet outputting apparatus for an image forming apparatus of claim 2, wherein the controlling means determines specific bins to which the sheets are to be discharged so that a total of number of sheets which are discharged to each specific bin is minimized.

4. The sheet outputting apparatus for an image forming apparatus of claim 2, wherein the controlling means determines specific bins to which sheets are to be discharged so that, after the sheets are discharged, the number of acceptable sheets of one bin is a maximum number of sheets that the bin can receive.

5. The sheet outputting apparatus for an image forming apparatus of claim 2, wherein the controlling means determines bins to which sheets are to be discharged so that, after the sheets are discharged, the number of empty bins which are successive represents a maximum number of bins.

6. The sheet outputting apparatus for an image forming apparatus of claim 2, wherein the controlling means determines specific bins to which sheets are to be discharged so that, after the sheets are discharged, a total of number of empty bins which are successive can receive a maximum number of sheets.

* * * * *